US011819977B2

(12) United States Patent
Thomas

(10) Patent No.: US 11,819,977 B2
(45) Date of Patent: Nov. 21, 2023

(54) INVERSION MOUNT FOR MOUNTING AN INVERTED DIE GRINDER

(71) Applicant: Toyota Motor Engineering & Manufacturing North America, Inc., Plano, TX (US)

(72) Inventor: Sunny Muttathukunnel Thomas, Kitchener (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 1330 days.

(21) Appl. No.: 16/265,453

(22) Filed: Feb. 1, 2019

(65) Prior Publication Data

US 2020/0246938 A1 Aug. 6, 2020

(51) Int. Cl.

| | |
|---|---|
| ***B24B 41/06*** | (2012.01) |
| ***B24B 19/20*** | (2006.01) |
| ***B21D 22/02*** | (2006.01) |

(52) U.S. Cl.

CPC ..... *B24B 41/06* (2013.01); *B24B 19/20* (2013.01); *B21D 22/02* (2013.01)

(58) Field of Classification Search

CPC . B24B 27/0015; B24B 27/0038; B24B 41/02; B24B 19/20; B25J 9/0018;

(Continued)

(56) References Cited

U.S. PATENT DOCUMENTS 1,189,756 A * 7/1916 van Diggelen ..... D21C 9/02 162/99

8,690,637 B2 * 4/2014 Pelotte ..... B24B 1/00 451/28

(Continued)

FOREIGN PATENT DOCUMENTS

| | | | |
|---|---|---|---|
| CN | 102699878 A * 10/2012 | | |
| CN | 106424831 A * 2/2017 | ..... | B23B 41/02 |
| DE | 102012009462 A1 11/2013 | | |

OTHER PUBLICATIONS

Bachman, K., "Articulating-arm die grinder accelerates automaker's tool and die maintenance," The Stamping Journal, Jul./Aug. 2017 (Jun. 23, 2017) https://www.thefabricator.com/article/stamping/articulating-arm-die-grinder-accelerates-automaker-s-tool-and-die-maintenance (last accessed Feb. 1, 2019).

(Continued)

*Primary Examiner* — Joel D Crandall

(74) *Attorney, Agent, or Firm* — Christopher G. Darrow; Darrow Mustafa PC

(57) ABSTRACT

An inversion mount includes an upper mounting base, a lower mounting base, and an oblique drop arm connected from the upper mounting base to the lower mounting base. The upper mounting base is configured to normally mount to a downward-facing inversion mounting surface from below. The lower mounting base includes a non-rotary main body and a rotary latch assembly. The main body includes a forward receiver configured to axially receive a mounting insert from below as a rotary item. The latch assembly includes a side latch. The side latch extends alongside the main body, and is supported for radial pivotation between an open position, in which the side latch carries the inside hook below but not underneath the forward receiver, and a latched position, in which the side latch carries the inside hook underneath the forward receiver for hooked engagement with a side pocket behind the mounting insert.

12 Claims, 4 Drawing Sheets

(58) Field of Classification Search
CPC ... B25J 9/06; B25J 9/065; B25J 9/1065; B25J 9/0036
See application file for complete search history.

(56) References Cited

U.S. PATENT DOCUMENTS

2016/0039093 A1* 2/2016 Abdallah ..... B25J 9/1687 700/258
2018/0079629 A1* 3/2018 Abdallah ..... B66C 13/48

OTHER PUBLICATIONS

S-36 Die Grinding Unit, FlexArm Inc., https://www.flexarminc.com/product-page/s-36-die-grinding-unit (last accessed Feb. 1, 2019).

* cited by examiner

INVERSION MOUNT FOR MOUNTING AN INVERTED DIE GRINDER

TECHNICAL FIELD

The embodiments disclosed herein relate to mounts and, more particularly, to mounts for mounting die grinders.

BACKGROUND

When mounted to nearby mounting surfaces, die grinders are particularly useful tools for grinding the cutting sections of a die stamping machine's stamping dies. However, with existing mounts, the in situ upper stamping dies of vertical die stamping machines must first be removed from the vertical die stamping machines, inverted, and resituated apart from the vertical die stamping machines.

SUMMARY

Disclosed herein are embodiments of an apparatus that includes an inversion mount and associated items. In one aspect, an apparatus includes an inversion mount. The inversion mount includes an upper mounting base, a lower mounting base, and an oblique drop arm connected from the upper mounting base to the lower mounting base. The upper mounting base is configured to normally mount to a downward-facing inversion mounting surface from below. The lower mounting base includes a non-rotary main body and a rotary latch assembly. The main body includes a forward receiver configured to axially receive a mounting insert from below as a rotary item. The latch assembly includes a side latch. The side latch extends alongside the main body, and is supported for radial pivotation between an open position, in which the side latch carries the inside hook below but not underneath the forward receiver, and a latched position, in which the side latch carries the inside hook underneath the forward receiver for hooked engagement with a side pocket behind the mounting insert. This and other aspects will be described in additional detail below.

BRIEF DESCRIPTION OF THE DRAWINGS

The various features, advantages and other uses of the present embodiments will become more apparent by referring to the following detailed description and drawing in which.

DETAILED DESCRIPTION

This disclosure teaches an inversion mount configured to mount an inverted die grinder to an inversion mounting surface of a vertical die stamping machine's in situ upper stamping die from below.

Figure 1:
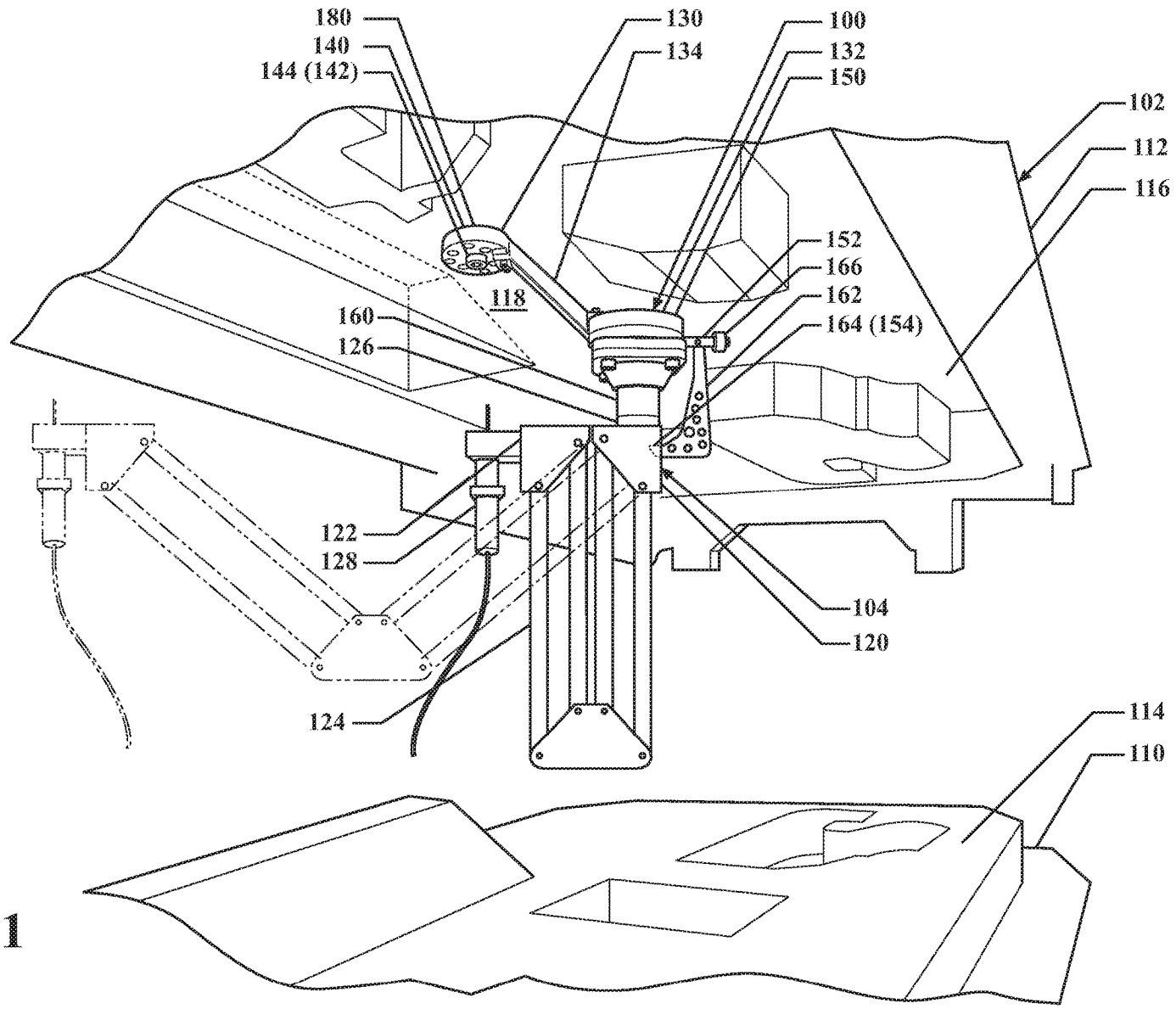
FIG. 1 is a perspective view of a schematically rendered vertical die stamping machine with an in situ upper stamping die, a schematically rendered inverted die grinder, and an inversion mount mounting the inverted die grinder to an inversion mounting surface of the in situ upper stamping die.

An apparatus that includes an inversion mount 100 and associated items is shown in FIG. 1. In addition to the inversion mount 100, the apparatus includes a vertical die stamping machine 102, and an inverted die grinder 104.

The vertical die stamping machine 102 is configured to cut sheet-like workpieces to desired profiles. For instance, the vertical die stamping machine 102 could be typical of those used in industrial automotive plants to cut sheet metal to the profiles of automotive body panels. It will be understood that this disclosure is not exclusive to the vertical die stamping machine 102 being configured to shape or otherwise process sheet-like workpieces in association with cutting them to desired profiles.

The vertical die stamping machine 102 has a vertical stamping axis. Along the vertical stamping axis, the vertical die stamping machine 102 includes a vertical press and an intermediate stamping die set installed to the vertical press. The stamping die set includes an in situ lower stamping die 110 and complementary in situ upper stamping die 112. The in situ lower stamping die 110 and the in situ upper stamping die 112 are supported by the vertical press for vertical movement relative to one another along the vertical stamping axis.

The in situ lower stamping die 110 includes a leading, upright, upward-facing lower cutting section 114. The in situ upper stamping die 112 includes an opposing complementary leading, upright, downward-facing upper cutting section 116. As shown, the lower cutting section 114 has a punch or otherwise male configuration, and the upper cutting section 116 has a complementary die or otherwise female configuration. Alternatively, or additionally, the lower cutting section 114 could have a die or otherwise female configuration, and the upper cutting section 116 could have a complementary punch or otherwise male configuration.

With sheet-like workpieces placed between them, the vertical press vertically advances the in situ lower stamping die 110 and the in situ upper stamping die 112 toward one another along the vertical stamping axis. As part of vertically advancing the in situ lower stamping die 110 and the in situ upper stamping die 112, the vertical press vertically bypasses the lower cutting section 114 and the upper cutting section 116. Using the vertically bypassing lower cutting section 114 and upper cutting section 116, the vertical press cuts sheet-like workpieces placed between the in situ lower stamping die 110 and the in situ upper stamping die 112 to desired profiles. Specifically, the vertically bypassing lower cutting section 114 and upper cutting section 116 assume a cutting clearance therebetween effective for cutting sheet-like workpieces placed between the in situ lower stamping die 110 and the in situ upper stamping die 112 to desired profiles.

Among other things, the cutting action by the vertically bypassing lower cutting section 114 and upper cutting section 116, including but not limited to the cutting clearance assumed therebetween, relies on the geometric accuracy of the lower cutting section 114 and the upper cutting section 116. Accordingly, as part of maintaining the vertical die stamping machine 102, it is important to maintain the geometric accuracy of the lower cutting section 114 and the upper cutting section 116. For instance, over time, the cutting action by the vertically bypassing lower cutting section 114 and upper cutting section 116 may tend to diminish the geometric accuracy of the lower cutting section 114 and the upper cutting section 116 by removing material therefrom. Typically, to maintain the geometric accuracy thereof, new material is welded or otherwise permanently integrated into the lower cutting section 114 and the upper cutting section 116, and the lower cutting section 114 and the upper cutting section 116 are ground at the site of the new material until the once-diminished geometric accuracy thereof is restored.

In conjunction with the inversion mount 100, the inverted die grinder 104 is a particularly useful tool for grinding the upper cutting section 116. In relation to the inversion mount 100 and the inverted die grinder 104, the in situ upper stamping die 112 includes a downward-facing inversion mounting surface 118. As shown, the inversion mount 100 is configured to mount the inverted die grinder 104 to the inversion mounting surface 118 from below. Specifically, the inversion mount 100 is configured to mount to the inversion mounting surface 118 from below, and configured to mount the inverted die grinder 104 thereto from below. The inversion mounting surface 118 may, for example, be native to the in situ upper stamping die 112. The inversion mounting surface 118 may, for example, belong to a suitable adaptor and added to the in situ upper stamping die 112 by mounting the adaptor thereto.

As shown, the inverted die grinder 104 may, for example, be a modified version of a FlexArm die grinder available from FlexArm, Inc. of Wapakoneta, Ohio. The inverted die grinder 104 includes a mounting head 120, an opposing grinding head 122, and an intermediate manually-operated kinematic linkage 124. The mounting head 120 includes a mounting insert 126, and the grinding head 122 includes a pneumatic or other type of power rotary grinding tool 128 with a suitable grinding bit. As further set forth below, in relation to the mounting insert 126, the inversion mount 100 has a receiver-style configuration for axially receiving the mounting insert 126 from below as a rotary item. The kinematic linkage 124 is connected from the mounting head 120, behind the mounting insert 126, to the grinding head 122. The kinematic linkage 124 is configured to support the grinding head 122 relative to the mounting head 120 for rectilinear translation. As shown, the kinematic linkage 124 may, for example, have a series dual four-bar configuration.

As further set forth below, with the inversion mount 100 mounting the inverted die grinder 104 to the inversion mounting surface 118, the grinding head 122 is supported for non-tilting relocation about the inversion mounting surface 118, including any combination of translational relocation away from and toward the mounting head 120, and revolutionary relocation about the mounting insert 126. With the grinding head 122 supported for non-tilting relocation about the inversion mounting surface 118, the grinding head 122 maintains its orientation to the upper cutting section 116, including for non-tilting grinding contact therewith, whereupon the upper cutting section 116 is ground using the grinding tool 128. As shown, from the perspective of the grinding tool 128, the grinding head 122 may, for example, have a perpendicular orientation to the upper cutting section 116.

Beyond the characteristic advantage of the inverted die grinder 104, that the grinding head 122 maintains its orientation to the upper cutting section 116, the inversion mount 100 offers the added advantage of mounting the inverted die grinder 104 to the inversion mounting surface 118 of the in situ upper stamping die 112. Specifically, existing mounts for FlexArm die grinders are only configured to mount to upward-facing mounting surfaces from above. Relatedly, existing mounts for FlexArm die grinders are only configured to mount FlexArm die grinders thereto from above via receiver-style configurations for axially receiving their mounting inserts from above as gravity-secured and gravity-seated rotary items. Accordingly, in order to employ FlexArm die grinders as tools for grinding the upper cutting section 116, the in situ upper stamping die 112 must first be removed from the vertical die stamping machine 102, inverted, and resituated apart from the vertical die stamping machine 102. Moreover, once it is ground, the removed, no-longer in situ upper stamping die 112 must be reinstalled to the vertical die stamping machine 102. All of this adds both difficulty and downtime to the task of grinding the upper cutting section 116.

Figure 2A:
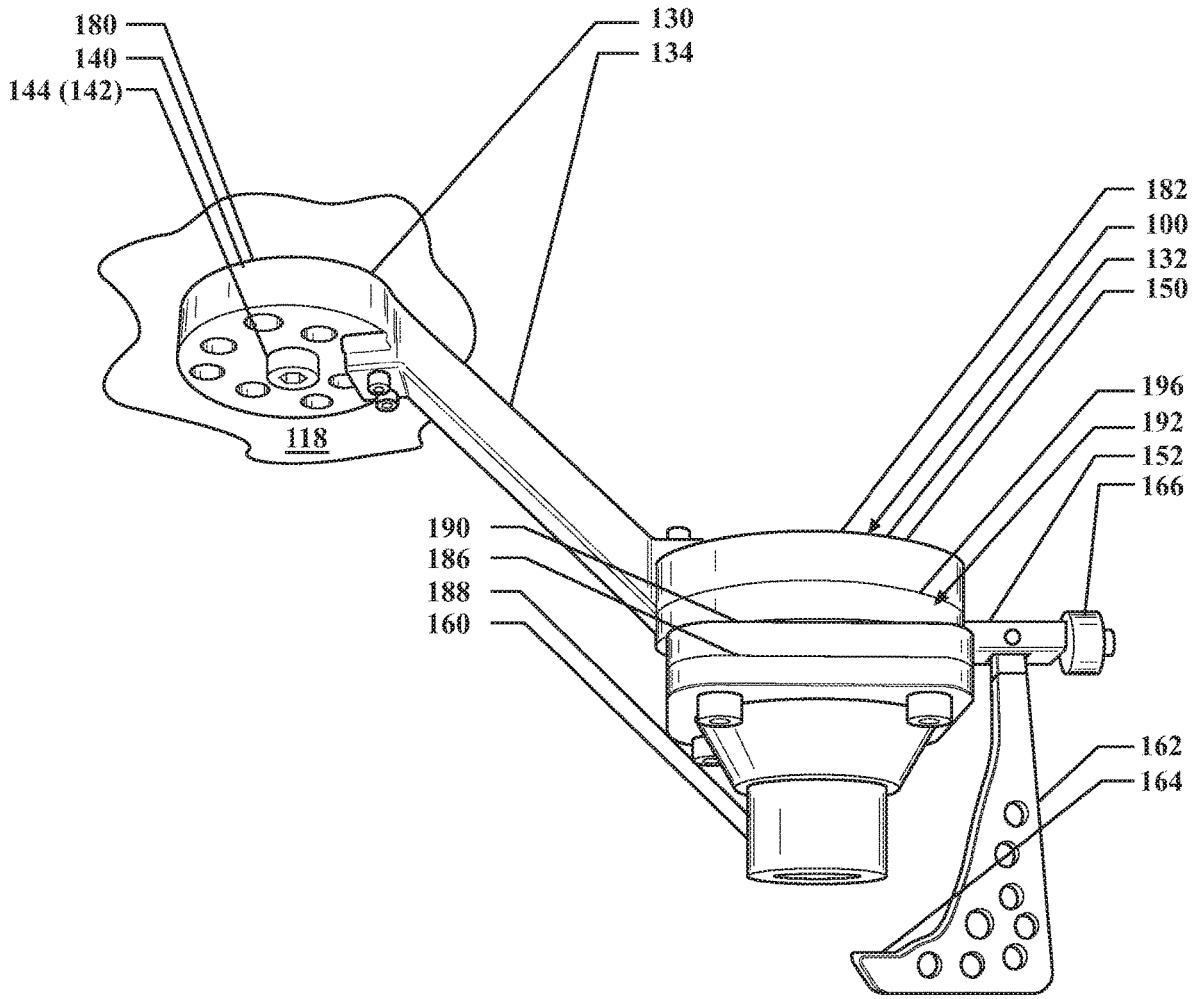
FIGS. 2A and 2B are a perspective view and an assembly view, respectively, of the inversion mount, showing aspects of the construction and the configuration thereof.
Figure 2B:
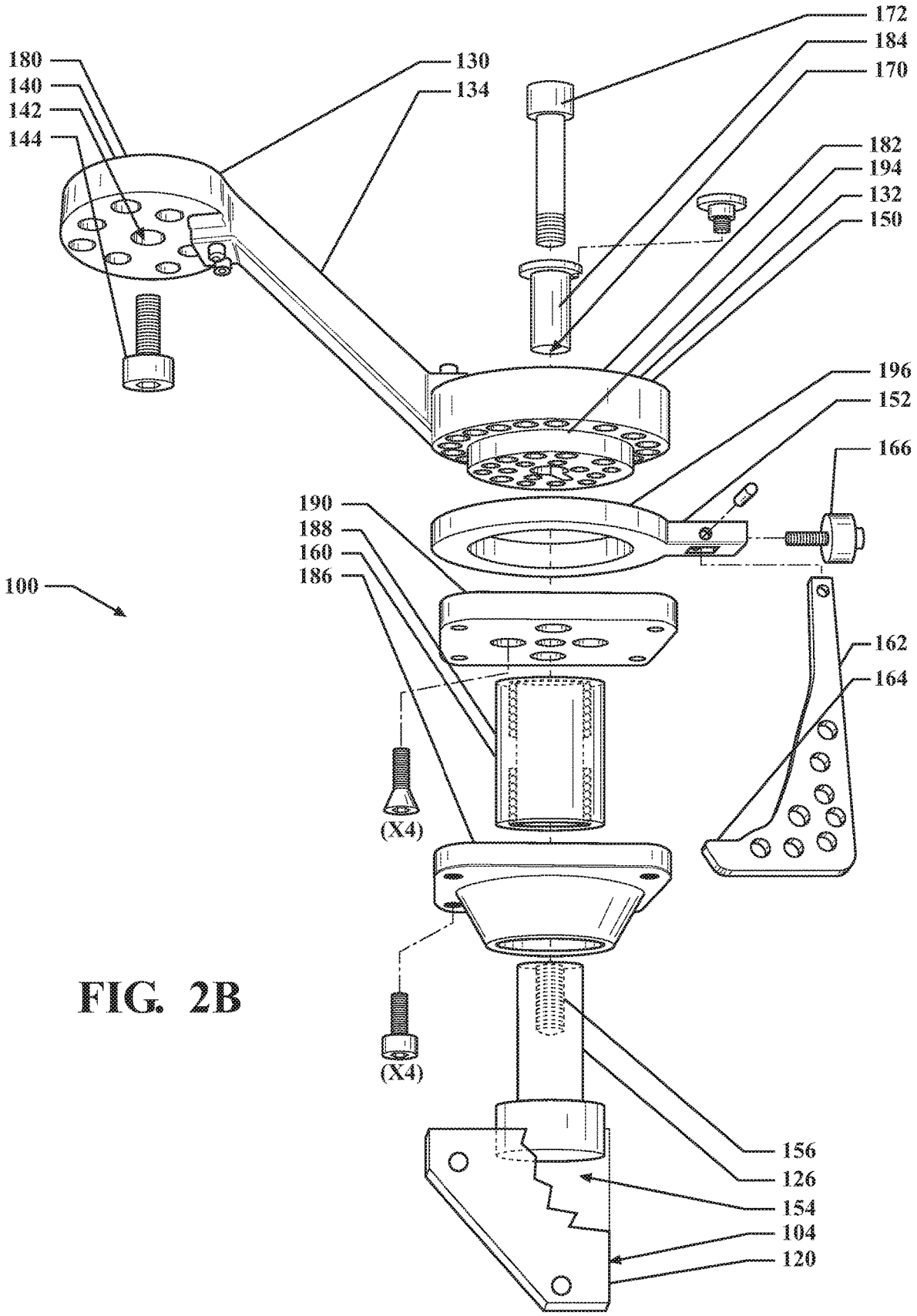

As shown with additional reference to FIGS. 2A and 2B, the inversion mount 100 includes an upper mounting base 130. The upper mounting base 130 is configured to normally mount to the inversion mounting surface 118 from below. Moreover, the inversion mount 100 includes a lower mounting base 132. The lower mounting base 132 is configured to mount the inverted die grinder 104 thereto from below. In addition to the upper mounting base 130 and the lower mounting base 132, the inversion mount 100 includes an oblique drop arm 134 connected from the upper mounting base 130 to the lower mounting base 132. The oblique drop arm 134 is configured to immovably suspend the lower mounting base 132 below but not underneath the upper mounting base 130 in the same orientation as the upper mounting base 130.

The upper mounting base 130 is configured to normally bolt to the inversion mounting surface 118 from below. As shown, the upper mounting base 130 includes a rear face 140. The rear face 140 is configured to engage the inversion mounting surface 118 from below. Moreover, with the inversion mounting surface 118 including one or more forward threaded holes, the upper mounting base 130 includes one or more front bolt holes 142. With the oblique drop arm 134 immovably suspending the lower mounting base 132 from the upper mounting base 130 below but not underneath the upper mounting base 130 in the same orientation as the upper mounting base 130, the front bolt holes 142 are accessible from below. Relatedly, the front bolt holes 142 are configured to receive one or more bottom bolts 144 therethrough from below, including with the rear face 140 engaging the inversion mounting surface 118, for threaded engagement with the forward threaded holes to thereby normally bolt the upper mounting base 130 to the inversion mounting surface 118 from below.

The lower mounting base 132 includes a non-rotary main body 150. Moreover, the lower mounting base 132 includes a rotary latch assembly 152. The main body 150 is configured to axially support the latch assembly 152 for axial rotation. As shown, in relation to the latch assembly 152, the mounting head 120 includes a side pocket 154 behind the mounting insert 126. Moreover, in relation to the main body 150, the mounting insert 126 includes a forward threaded hole 156.

The main body 150 includes a bearinged forward receiver 160. The main body 150 is configured to axially support the forward receiver 160, and the forward receiver 160 is configured to axially receive the mounting insert 126 from below as a rotary item. With the mounting insert 126 axially received therein, the forward receiver 160 is configured to axially support the mounting insert 126 for axial rotation. At the same time, the forward receiver 160 is configured to support the mounting head 120 for revolution about the mounting insert 126.

The latch assembly 152 includes a side latch 162. The side latch 162 includes an inside hook 164. The side latch 162 extends alongside the main body 150, with the inside hook 164 structured to extend below the forward receiver 160.

The latch assembly 152 is configured to support the side latch 162 for radial pivotation, including between an open position, in which the inside hook 164 extends below but not underneath the forward receiver 160, and a latched position, in which inside hook 164 extends underneath the forward receiver 160, including with the mounting insert 126 axially received in the forward receiver 160, for hooked engagement with the side pocket 154 from the side to thereby rotationally secure the mounting insert 126 with respect to the forward receiver 160. From its position in hooked engagement with the side pocket 154, the inside hook 164 is configured to integrate the mounting insert 126 and the latch assembly 152 for common axial rotation.

Moreover, the latch assembly 152 includes a manually-operable adjustment knob 166. The adjustment knob 166 is operable to manage the radial pivotation of the side latch 162. With the side latch 162 in the open position, the adjustment knob 166 is operable to allow the side latch 162 to radially pivot to the latched position. With the side latch 162 in the latched position, the adjustment knob 166 is operable to allow the side latch 162 to radially pivot to the open position. Alternatively, with the side latch 162 in the latched position, the adjustment knob 166 is operable to lock the side latch 162 in the latched position.

The main body 150 includes a bushed rear bolt hole 170 opening to the forward receiver 160. With the oblique drop arm 134 immovably suspending the lower mounting base 132 from the upper mounting base 130 below but not underneath the upper mounting base 130, the rear bolt hole 170 is accessible from above. Moreover, the main body 150 includes a top bolt 172. The rear bolt hole 170 is configured to receive the top bolt 172 therethrough from above, including with the mounting insert 126 axially received in the forward receiver 160, for threaded engagement with the forward threaded hole 156 to thereby seat the mounting insert 126 in the forward receiver 160. With the top bolt 172 received therethrough, the rear bolt hole 170 is configured to axially support the top bolt 172 for axial rotation. From its position in threaded engagement with the forward threaded hole 156, the top bolt 172 is configured to integrate the mounting insert 126 and the top bolt 172 for common axial rotation.

With the mounting insert 126 secured and seated in the forward receiver 160, the inverted die grinder 104 is mounted to the lower mounting base 132. Despite the inside hook 164 and the top bolt 172 integrating the mounting insert 126 and the latch assembly 152 and the top bolt 172, respectively, for common axial rotation, with the main body 150 axially supporting the latch assembly 152 for axial rotation, and with the rear bolt hole 170 axially supporting the top bolt 172 for axial rotation, the forward receiver 160 is free to axially support the mounting insert 126 for axial rotation. With the upper mounting base 130 normally mounted to the inversion mounting surface 118 and the inverted die grinder 104 mounted to the lower mounting base 132, the inversion mount 100 mounts the inverted die grinder 104 to the inversion mounting surface 118. With the inversion mount 100 mounting the inverted die grinder 104 to the inversion mounting surface 118, the grinding head 122 is supported via the forward receiver 160, the kinematic linkage 124 and the mounting insert 126 for non-tilting relocation about the inversion mounting surface 118, including any combination of translational relocation away from and toward the mounting head 120, and revolutionary relocation about the mounting insert 126. As noted above, with the grinding head 122 supported for non-tilting relocation about the inversion mounting surface 118, the grinding head 122 maintains its orientation to the upper cutting section 116, including for non-tilting grinding contact therewith, whereupon the upper cutting section 116 is ground using the grinding tool 128.

In a single-piece construction thereof, the upper mounting base 130 includes a disk-like mounting plate 180, from where the oblique drop arm 134 is connected from the upper mounting base 130 to the lower mounting base 132. As shown, the mounting plate 180 has one side defining the rear face 140, and is apertured to define the front bolt holes 142 therethrough.

In an integrated multi-piece construction thereof, the main body 150 includes a disk-like rear plate 182, from where the oblique drop arm 134 is connected to the lower mounting base 132 from the upper mounting base 130. Moreover, the main body 150 includes a bushing 184 anchored in the rear plate 182, and defines the rear bolt hole 170 through the bushing 184. Moreover, the main body 150 includes a forward bearing seat 186, and an axially aligned forward bearing 188 anchored in the forward bearing seat 186, to form the forward receiver 160. Moreover, the main body 150 includes an adaptor plate 190 interconnected between the rear plate 182 and the forward bearing seat 186. As shown, the rear plate 182, the forward bearing seat 186 and the adaptor plate 190 are apertured for bolted interconnection. In relation to the latch assembly 152, the main body 150 includes an annular side groove 192 behind the forward receiver 160. In the integrated multi-piece construction of the main body 150, the rear plate 182 includes a narrowing forward step 194, and the main body 150 defines the annular side groove 192 between the narrowing forward step 194 and the adaptor plate 190.

In an integrated multi-piece construction thereof, the latch assembly 152 includes a rotary collar 196 riding in the annular side groove 192. With the collar 196 riding in the annular side groove 192, the annular side groove 192 is configured to axially support the collar 196 for axial rotation. Moreover, the side latch 162 is connected from the collar 196, and the collar 196 is configured to support the side latch 162 for radial pivotation. Moreover, the adjustment knob 166 is engaged between the collar 196 and the side latch 162.

Figure 3:
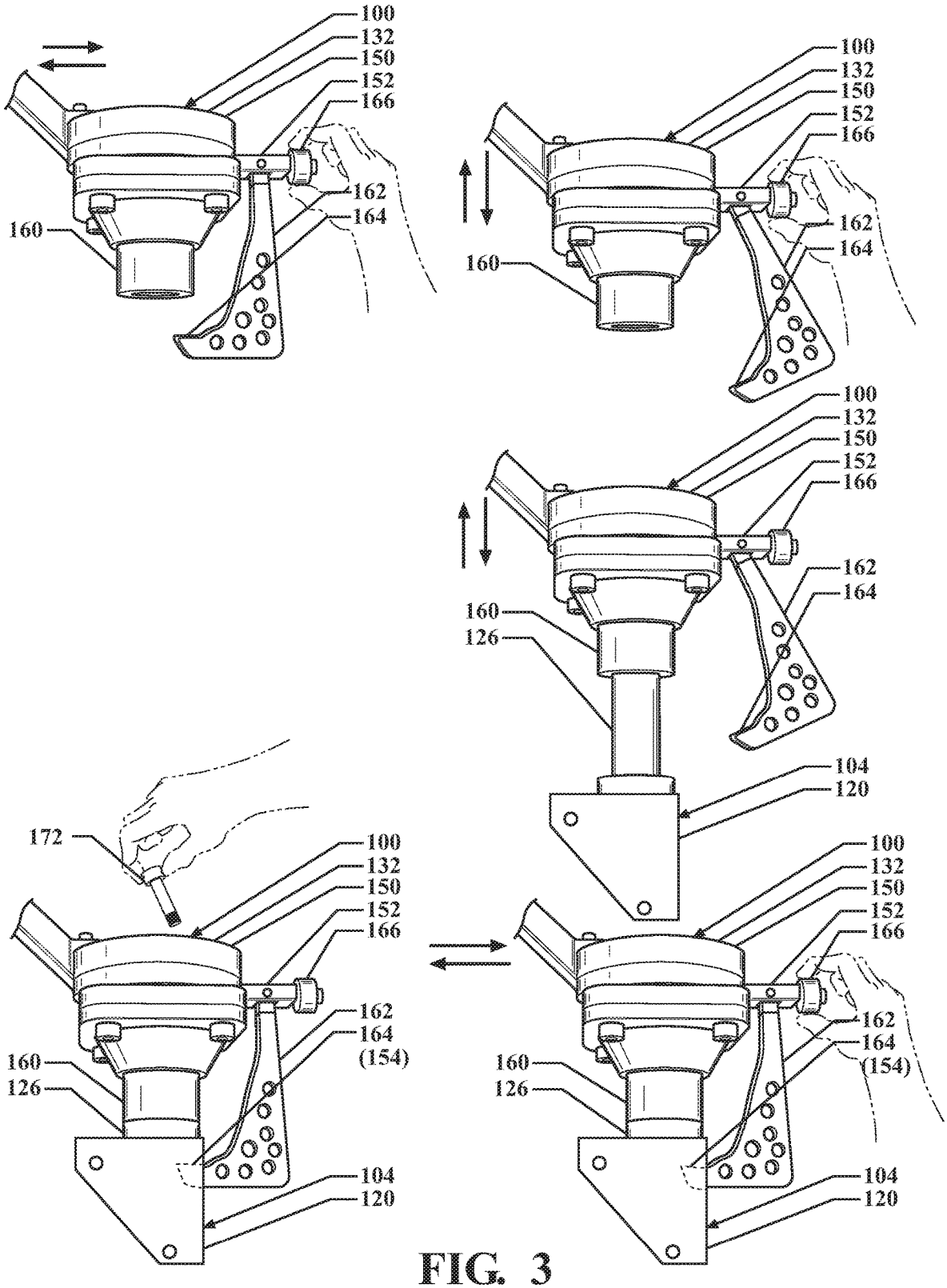
FIG. 3 represents, with reference to partial perspective views of the inversion mount and the inverted die grinder, the progressions of an example mounting cycle involving the inverted die grinder being mounted to the inversion mount, and the progressions of an example unmounting cycle involving the inverted die grinder being unmounted from the inversion mount.

Both an example mounting cycle involving the inverted die grinder 104 being mounted to the inversion mount 100, and an example unmounting cycle involving the inverted die grinder 104 being unmounted from the inversion mount 100, are represented in FIG. 3. The mounting cycle progresses in the clockwise direction, and the unmounting cycle progresses in the counterclockwise direction. This description follows with reference to the mounting cycle. However, it will be understood that this description is applicable in principle to the unmounting cycle.

At the beginning of the mounting cycle, with the side latch 162 in the latched position, the adjustment knob 166 is operated to allow the side latch 162 to radially pivot to the open position. With the side latch 162 in the open position, the inside hook 164 is carried below but not underneath the forward receiver 160, leaving the forward receiver 160 accessible from below. Next, the forward receiver 160 axially receives the mounting insert 126 from below as a rotary item. Next, the adjustment knob 166 is operated to allow the side latch 162 to radially pivot to the latched position. With the side latch 162 in the latched position, the inside hook 164 is carried underneath the forward receiver 160 for hooked engagement with the side pocket 154 from the side to thereby secure the mounting insert 126 in the forward receiver 160. In association with being operated to allow the side latch 162 to radially pivot to the latched position, the adjustment knob 166 is operated to lock the side latch 162 in the latched position. Next, the rear bolt hole 170 receives the top bolt 172 therethrough from above for threaded engagement with the forward threaded hole 156 to thereby seat the mounting insert 126 in the forward receiver 160.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus, the apparatus comprising:

an inversion mount, the inversion mount including an upper mounting base, a lower mounting base, and an oblique drop arm connected from the upper mounting base to the lower mounting base, the upper mounting base structured to normally mount to a downward-facing inversion mounting surface from below, and the lower mounting base including a non-rotary main body and a rotary latch assembly, the main body including a forward receiver structured to axially and rotatably receive a mounting insert from below, and the rotary latch assembly including a side latch having an inside hook, the side latch extending alongside the main body, and the side latch being supported for radial pivotation between an open position, in which the inside hook extends below but not underneath the forward receiver, and a latched position, in which the inside hook extends underneath the forward receiver for hooked engagement with a side pocket behind the mounting insert.

2. The apparatus of claim 1, wherein the upper mounting base is further structured to bolt to the inversion mounting surface from below.

3. The apparatus of claim 1, wherein the forward receiver includes a bearing.

4. The apparatus of claim 1, wherein the main body further includes a rear bolt hole configured to receive a top bolt therethrough from above for threaded engagement with a forward threaded hole of the mounting insert, and axially support the top bolt for axial rotation.

5. The apparatus of claim 4, wherein the rear bolt hole is formed in a bushing anchored in the main body.

6. The apparatus of claim 1, wherein the latch assembly includes an adjustment knob operable to manage the radial pivotation of the side latch.

7. The apparatus of claim 6, wherein with the side latch in the latched position, the adjustment knob is operable to lock the side latch in the latched position.

8. The apparatus of claim 1, wherein the main body defines an annular side groove, the latch assembly includes a rotary collar configured to ride in the annular side groove for axial rotation, and the side latch is connected from the collar to support the side latch for radial pivotation.

9. The apparatus of claim 8, wherein the latch assembly includes an adjustment knob engaged between the collar and the side latch, the adjustment knob operable to manage the radial pivotation of the side latch.

10. The apparatus of claim 1, further comprising:

a vertical die stamping machine, the vertical die stamping machine including an in situ upper stamping die with a downward-facing upper cutting section and the inversion mounting surface.

11. The apparatus of claim 1, further comprising:

an inverted die grinder, the inverted die grinder including a mounting head, a grinding head and a kinematic linkage connected from the mounting head to the grinding head, the mounting head including the mounting insert, and the side pocket behind the mounting insert, and the grinding head including a power rotary grinding tool.

12. The apparatus of claim 11, wherein the mounting insert includes a forward threaded hole, and the main body includes a rear bolt hole configured to receive a top bolt therethrough from above for threaded engagement with the forward threaded hole, and axially support the top bolt for axial rotation.

* * * * *